US005394913A

United States Patent [19]

Zezza, Jr. et al.

[11] Patent Number: 5,394,913

[45] Date of Patent: Mar. 7, 1995

[54] HINGE FOR PERSONAL LEATHER GOODS

[75] Inventors: Carlo F. Zezza, Jr., Denver, Colo.; Michael M. Walter, Tonbridge, England; Richard Miles, London, England; Ian Ferris, Wokingham, England

[73] Assignee: Samsonite Corporation, Denver, Colo.

[21] Appl. No.: 774,029

[22] Filed: Oct. 10, 1991

[51] Int. Cl.[6] ..... A45C 1/00; B65D 43/14; E05D 5/12

[52] U.S. Cl. ..... 150/146; 150/118; 150/143; 190/901; 220/343; 16/380; 16/381; 16/385; 16/DIG. 13

[58] Field of Search ..... 150/100, 118, 119, 193, 150/131, 146; 190/109, 114, 901, 28; 220/343; 16/380, 381, 385, DIG. 13, DIG. 29

[56] References Cited

U.S. PATENT DOCUMENTS

| | | | |
|---|---|---|---|
| Re. 26,443 | 3/1965 | Kish, Jr. . | |
| 95,808 | 10/1869 | Killam . | |
| 376,597 | 1/1888 | Hoffman, Jr. . | |
| 963,494 | 7/1910 | Allen | 150/119 |
| 1,013,580 | 1/1912 | Babst | 150/100 |
| 1,023,238 | 4/1912 | Becker . | |
| 1,030,801 | 6/1912 | Berault | 16/380 X |
| 1,933,115 | 10/1933 | Jacobsen | 150/143 |
| 2,018,551 | 10/1935 | Freling | 190/901 X |
| 2,218,666 | 10/1940 | Tamoschat | 150/119 |
| 2,347,981 | 5/1944 | Apfelbaum | 220/343 |
| 2,487,951 | 11/1949 | Stein . | |
| 2,510,643 | 6/1950 | Long | 190/28 |
| 2,536,785 | 1/1951 | Tamoschat | 150/119 X |
| 2,684,136 | 7/1954 | Wheary . | |
| 2,716,473 | 8/1955 | Droutman . | |
| 2,719,322 | 10/1955 | Hager et al. | 16/380 |
| 2,781,809 | 2/1957 | Wolf . | |
| 2,790,198 | 4/1957 | Schoen et al. | 16/DIG. 29 X |
| 2,889,020 | 6/1959 | Kotkins . | |
| 2,969,822 | 1/1961 | Stein . | |
| 3,169,615 | 2/1965 | Stein | 190/114 |
| 3,318,362 | 5/1967 | Joyce, 3rd | 220/343 X |
| 3,593,365 | 7/1971 | Amundsen | 16/380 X |
| 3,698,522 | 10/1972 | Aronoff . | |
| 3,703,742 | 11/1972 | Konishi | 16/385 |
| 3,741,355 | 6/1973 | Slan . | |
| 3,958,676 | 5/1976 | March . | |
| 3,962,750 | 6/1976 | Buss et al. | 16/381 |
| 4,175,315 | 11/1979 | Hayes, Sr. et al. | 16/380 X |
| 4,231,135 | 11/1980 | Fradin | 16/380 X |
| 4,294,299 | 10/1981 | Dorsen et al. | 220/343 X |
| 4,383,142 | 5/1983 | Kaneko . | |
| 4,545,090 | 10/1985 | Redmond | 16/385 |
| 4,784,248 | 11/1988 | Workman | 190/126 |
| 4,809,402 | 3/1989 | Rainville | 16/385 X |
| 4,843,681 | 7/1989 | Mannato | 150/118 X |
| 5,031,734 | 7/1991 | King | 190/122 |

FOREIGN PATENT DOCUMENTS

| | | | |
|---|---|---|---|
| 730984 | 3/1966 | Canada | 190/109 |
| 742550 | 9/1966 | Canada | 190/109 |
| 1060691 | 4/1954 | France | 220/343 |
| 1169493 | 12/1958 | France | 16/380 |
| 695734 | 8/1953 | United Kingdom | 150/119 |
| 885300 | 12/1961 | United Kingdom | 16/DIG. 13 |
| 1014697 | 12/1965 | United Kingdom | 16/385 |
| 1451442 | 10/1976 | United Kingdom | 16/DIG. 13 |

*Primary Examiner*—Sue A. Weaver

*Attorney, Agent, or Firm*—Gregory W. O'Connor

[57] ABSTRACT

Personal leather goods (PLG's) such as wallets, billfolds, pocket calendars have a portion which is required to bend repeatedly. This bending causes cracking and extreme wear which adversely affects the looks of the item and reduces its useful life. Disclosed is a mechanical hinge which attaches to leather-like panels of such PLG's. The hinge includes a set of interleaving knuckles of relatively soft material which form an axial bore along the length of the hinge, the bore receiving a thin pintle made of a relatively stiff but resilient material. The pintle is shorter than the axial length of the bore and is held into the bore by end caps, either separately applied or integrally formed with the hinge leaf. The leaves of the hinge have an overall curving shape having a concave side and convex side to permit the panels to which the hinges attached to remain parallel when materials are received between them. Alternative constructions are shown, including a third panel comprising a paper binder-like spine or a body made of a series of independently attached knuckles and tubular body portions which in turn forms a second, expandable hinge-like body.

29 Claims, 4 Drawing Sheets

HINGE FOR PERSONAL LEATHER GOODS

BACKGROUND OF THE INVENTION

This invention relates to the field of personal leather goods (PLG's). Such items are usually carried by a person and used to organize or protect that person's effects. The personal leather goods category may include wallets, billfolds, checkbook covers, portfolios, binders, coin purses, document cases, business card cases, small photoframes for travel, and the like. More particularly though, this invention relates to those leather goods listed above and others which require a pair of panel sections or covers to hinge relative to one another (much like the covers of a book open and close) to permit access to pockets, papers, etc. positioned between those panels or covers. Thus, PLG's relating to the instant invention also include spectacle or sunglasses cases having a hinged cover, key cases, and the like.

Characterizing the sorts of goods which would most benefit from the subject invention is the use of a leather-like material (leather, split leather, and the class of materials commonly referred to as "artificial leather," for example polyurethane sponge leather, vinyl leather and the like) as the dominant or most obvious material from which the item is made. Such PLG's have a panel with such leather-like materials over one or both of its broad surfaces, the leather-like materials being stitched to adjacent layers which may include a fabric liner, or a liner of complementary or contrasting leather-like material or a rigidifying thermo-plastic or fiberboard layer.

As characterized above, most PLG's require one or both panel constructions to bend in order to provide this hinging action. While the leather-like materials and lining are specifically assembled and selected to permit this hinging action, inevitably during the useful life of the item in question, the bending panel (or at least the visible surface of the leather-like layers) becomes cracked and worn through constant flexing along the hinge line, or through rubbing of the surface material at the corners or edges at the hinge line. General scuffing and overall wrinkling of the leather-like panels is to be expected, and may be part of the appeal of such constructions. But, the flexing edge takes the brunt of the wear, thus reducing both the aesthetic desirability of the item in question or indeed its practical useful life.

OBJECTS OF THE INVENTION

Accordingly, disclosed is a hinge and elements for a hinge which smoothly integrate with the leather-like panels in the personal leather goods, and take the brunt of the wear and tear involved with this hinging or flexing operation. This hinge construction has the ability to be attached to the leather-like panels in a manner befitting the fine leatherwork, but also provides a durable, aesthetically pleasing, high technology look to the hinged construction. This attachment or integration is accomplished in a number of ways, including rivets and the like, but most preferably by the use of a tapered, flexible tongue which can be inserted into the panel construction and attached by fine stitching ( characteristic of good leather work), and leather-compatible glues.

BRIEF DESCRIPTION OF THE INVENTION

Accordingly, applicant has provided a hinge for PLG's or the like comprising a first hinge leaf and a second hinge leaf. The first hinge leaf and the second hinge leaf are substantially identical, each having a series of knuckles spaced along one edge. These hinged knuckles are spaced one from another to permit the knuckles of each leaf to be interlaced to form a hinge. The hinge knuckles include axially aligned bores for receiving a pintle. The first knuckle, which is adjacent to the end of each hinge leaf is spaced inwardly from the end of the hinge leaf. The hinge also includes an end cap which has a cover normally positioned in that space defined between the end of the hinge leaf and that first knuckle. In this way, the pintle is held in the axial bore by the end cap and the end cap is substantially flush and submerged in the space.

Also disclosed is a wallet, checkbook cover, portfolio, binder or the like having at least one panel comprising a layer of leather-like material on one major surface, and a liner on the other which form an elongated pocket along one edge. This item also includes a hinge with the first leaf having a series of spaced knuckles along one longitudinal dimension parallel to the one edge of the panel. A tongue extends along that longitudinal dimension into that pocket. The series of knuckles engage a second set of knuckles carried on a second panel of the wallet. The hinge leaf is made of a resilient flexible material which preferably compliments the flexibility and resilience of the panel attached to the leaf. The knuckles of the leaves are attached one to another by a pintle captured in an axial bore through the knuckles. This pintle is slightly stiffer than the leaf and has a length substantially shorter than the overall axial dimension of the bore. The hinge includes means such as an end cap for capturing this relatively short pintle in the bore.

Also disclosed is a hinge for attaching a panel to another member with the panel having a layer of leather-like materials. This hinge has a first leaf which includes knuckles arranged along one longitudinal edge. These knuckles are spaced one from another to receive a series of knuckles on the other member. The leaf includes a body portion connected to the first series of knuckles and it has a protruding tongue or pocket for attaching the leaf to the panel. The leaf has an overall shape which curves about an axis parallel to that longitudinal edge such that when the first leaf is attached to the panel and is overlying the other member, the panel overlays the other member neatly in a substantially compact manner.

DETAILED DESCRIPTION OF THE PREFERRED EMBODIMENT

Figure 1:
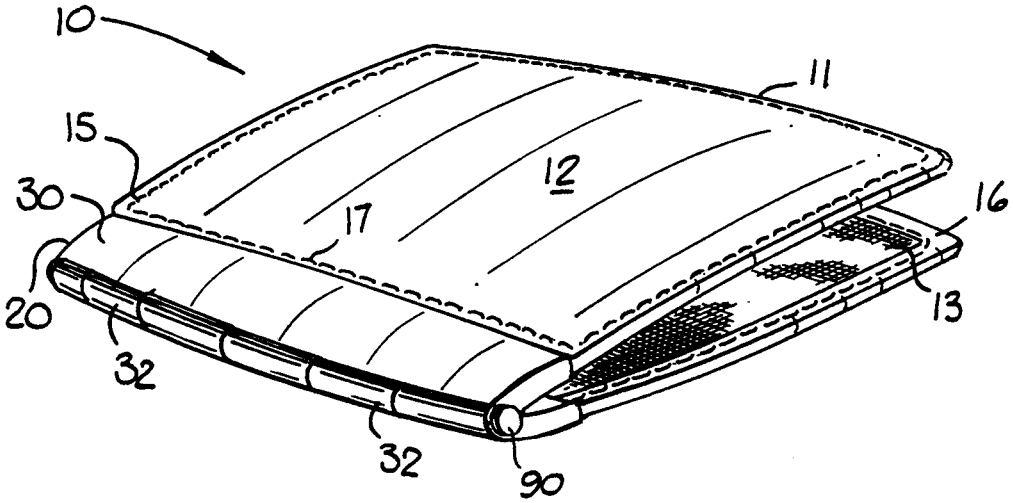
FIG. 1 shows a type of personal leather good utilizing the hinge construction of the preferred embodiment.

A small leather product, in particular, a wallet 10 (FIG. 1) includes one and preferably two lined panels 11 which normally lie in parallel planes overlying one another when the wallet is folded. The inventive hinge 20 is preferably attached by stitching 17 to both the panels 11. The hinge includes a pair of facing leaves 30 both of which include knuckles 32, forming a series of spaced knuckles which interleave with the knuckles 32 of the other leaf to form a butt hinge or the like. Axially aligned and adjacent to the series of interleaving knuckles 32 are end caps 90 which will be detailed below.

Figure 2:
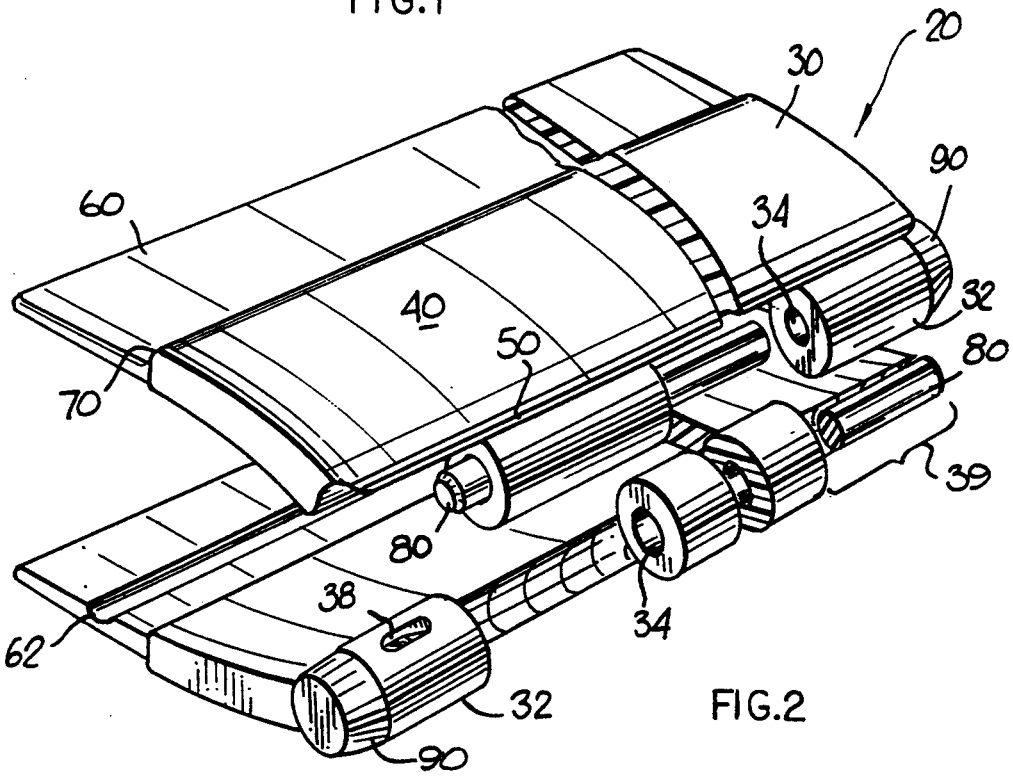
FIG. 2 shows an exploded view of broken away portion of the hinge construction.
Figure 6:
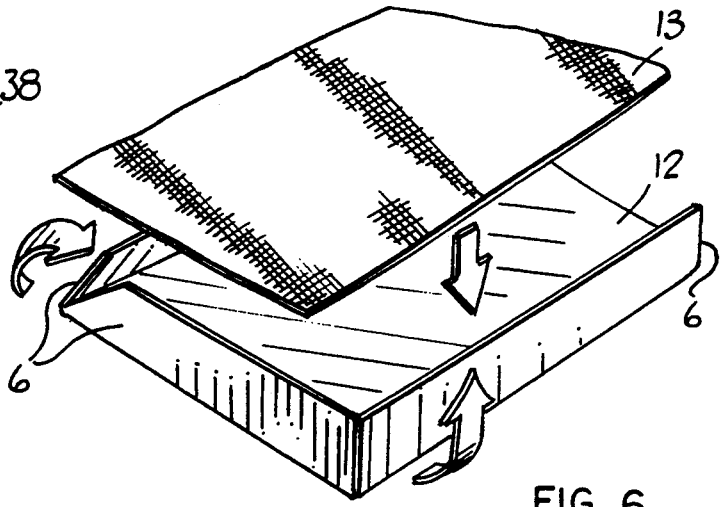
FIG. 6 and FIG. 7 show steps in the construction and installation of the hinged panel.

The panels 11 may have many constructions, but preferably include a leather or leather like layer 12 which extends over substantially the full major surface of the panel. This basic construction is fairly conventional except for the integration of the hinge 30. As detailed in FIGS. 6 and 7, the panel includes a liner 13 on the obverse face of the finished side of the leather panel 12. The edges are preferably finished with a wrapped edge 16 which is formed by cut and scived edge portions of the leather panel 12 wrapped around the raw edge of the liner 13. This whole assembly is glued and stitched at 15 together to form a finished panel. FIG. 2 shows details of the hinge 20 in FIG. 1. The hinge comprises two main portions called leaves 30 in FIG. 1. Each leaf includes knuckles 32, each having a bore 34. Between each knuckle is a space 39 with an axial dimension exactly equal to the length of knuckle 32 of the adjoining leaf. This spaced relationship exists throughout the longitudinal extent of each leaf except at the ends which will be detailed. Body portion of the leaf is generally planar with an overall curve which extends along the length of the leaf (see FIGS. 1 and 4 in particular). The body portion 40 of the leaf 30 joins the knuckles 32 at a continuous ridge 50. A tongue 60 extends from a continuous ridge or step 70 which drops down to the reduced thickness of the tongue portion 60. Note the step preferably is continuous around the entire juncture of the tongue 60 and the rest of the leaf as seen clearly in FIGS. 2, 3, and 8. The tongue 60 includes a groove 62 running along a concave side thereof. As will be detailed, stitch line 17 shows where the tongue is to be sewn to the panel 12. The groove 62 forms an area of reduced cross section so that the combination of the tongue and panel flexes at this location to further reduce the tendency of the assembly to flex at the stitch line or at the outer edge of the tongue.

Pintle 80 extends along almost the entire length of each leaf 30 and attaches the series of interleaving flexible knuckles between the two leaves. The endmost knuckle 32 includes a laterally extending cavity 38. As seen from the endview shown in FIG. 4, the cavity 38 connects into a keyway 36 along the portion of the axial bore in the end most knuckle 32.

An end cap 90 has a cover portion 92 at one end and a split shaft 94 at the other. A portion of the split shaft 94 includes a key 96 carrying a detent 98 and a ramp surface 99 at its distal end. When the end cap 90 is assembled, the split shaft is forced into the axial hole 34 past the ramp surface 99, which deflects the half of the split shaft until the detent 98 is aligned with the cavity 38, wherein it springs out to hold the end cap (and as will be detailed, the pintle) in place. The body portion 40 terminates at each of the spaces 39 between the knuckles and a concave cylindrical surface. The shape of this surface substantially corresponds to the other surface of the corresponding knuckle received in the space. This is true at the extreme end shown at each opposite end of the leaf. At the left most end (FIG. 3) of the leaf 30, the space 39 substantially corresponds to the axial dimension of the cover portion 92 of the end cap, and thus permits the end cap to be smoothly integrated with the body portion of each leaf and prevents the end cap from snagging on the clothing of the user. The end cap 90 has a generally cylindrical shape which tapers to form a conical surface on one side. The end cap 90 could be constructed or coated with a material having metallic appearance such as a precious or semi-precious metal. This is to impart a sparkling, jewel-like appearance without the disadvantages of separate metal adornments or accents.

Figure 3:
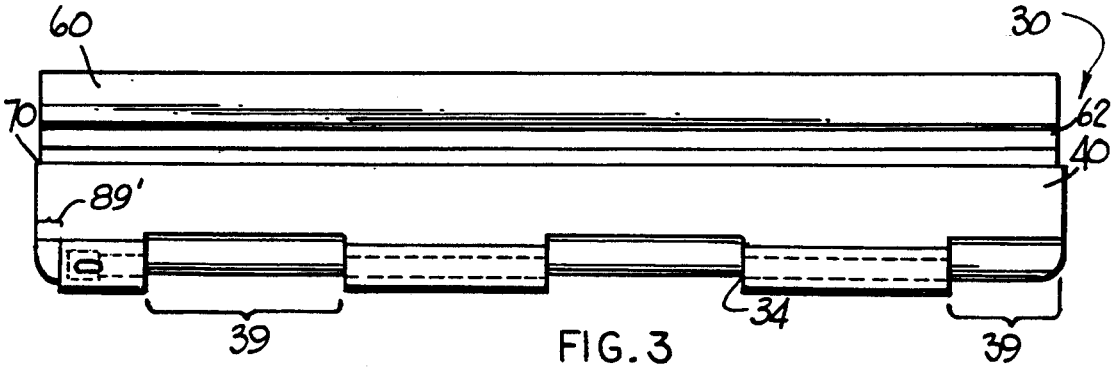
FIG. 3 is a plan view of a leaf of the hinge construction.

At the right most end of FIG. 3 another space 39 is shown. Here, that space substantially corresponds to the axial length of the corresponding end most knuckle 32 of the overlying leaf together with its end cap 90. Thus, when assembled, the two leaves present a striking appearance of a continuous cylindrical shape formed by the series of knuckles. This look is helped by the continuous ridge 50 at the junction of the series of interlacing knuckles and body portions 40. This Ridge 50 also serves as a stop when the hinge is opened to help prevent tearing softer hinge materials when the PLG is opened too far.

The relationship of the pintle 80 and the end caps 90 will now be set forth. In the preferred embodiment, each leaf 40 is made of a resilient, somewhat flexible, but extremely durable polymeric or elastomeric material polycarbonate urethane, or elastomeric alloy. The characteristics of preferred polymer are such that it will flex easily (given the increased thickness of the body portion 40) with the flexing of the inherently flexible panels 11 but will give good mechanical wear and strength in the axial bore 34. This will permit not only the tongue portion 60 to flex (in spite of the stress of being sewn to flexible panel 11) but also permit the overall construction to bend about an axis perpendicular to the overall length of the hinge. Such material can be polypropylene, nylons including rubber modified nylon, flexible polyurethane, flexiblized polyvinylchloride, polyvinylchloride with chlorinated polyethylene modifiers, ethylvinyl acetate (EVA) polymers, or polypropylene and alloys thereof. Most preferred are 1) the ionomer resin based polymers such as Surlyn® metallic salt based ethylene copolymer from Dupont, 2) Santoprene® partially vulcanized olefinic based thermoplastic rubber, and 3) Hytrel® polyester based thermoplastic rubber also from Dupont.

However, the material for the pintle 80 is selected from a much stiffer but similarly resilient material. This is to give the mechanical portion of the hinge construction some rigidity along its length and to provide a spring force to straighten the hinge so that it can open and close easily. Thus, pintle 80 may be made from one or more cylindrical pieces of fiber reinforced plastic. Examples of these materials are pultruded epoxy and fiberglass or polyester and fiberglass constructions. Fiber filled injection molded rods could also be used.

Carbon fibers may be used to give extreme resiliency and toughness thus providing considerable straightening force, even though the diameter of such pintle may be extremely small.

By "stiffer" is meant the material chosen for the pintle should have a resistance to bending which is greater than that of the material making up the leaves. The resilience of the material should permit the pintle to bend considerably without permanent deformation or without breaking. In the case of one combination of materials, a fiber reinforced plastic rod used for the pintle may have a stiffness, expressed in terms of modulus of elasticity (per ASTM D-790) in the range of about 400,000 psi (glass filled injection molded polycarbonate) to about $10\times10^6$ psi (for carbon fiber reinforced pultruded rod) In radical contrast, the modulus of elasticity (per ASTM D-412) of the polymer material of the hinge leaves could be as low as between about 70 and about 1400 psi for Santoprene® compounds, or as high as (per ASTM D-790) between about 14,000 psi and about 55,000 psi for Surlin® materials. Both portions of the hinge (the pintle and the leaf) must be resilient enough to permit them to be repeatedly bent to an extreme degree without permanent yielding or breakage.

Thus, to best benefit from this aspect of the invention, the ratios of flexural moduli for various combinations of materials used for the pintle to that used for the leaves can be as low as 1 to about 7, but are preferably in the range of 1 to about 200 to 1 to about 1,000. The uppermost limit of this ratio is set only by the difficulty for hinge knuckles made of extremely soft elastomeric materials to hold an extremely thin pintle made of a very stiff fiber reinforced compound. But even at extremely high ratios of about 1 to 20,000 (estimated by comparing the ASTM D-412 modulus for one Santoprene compound with the ASTM D-710 for a typical pultruded material) the benefits of using these differing materials in the disclosed construction can be had.

It has been found desirable that the overall length of the pintle 80 is such that it terminates one to two mm short of the innermost end surface of the split shaft 94 of the end caps 90. This permits the pintle to float freely and not press on the end caps when the hinge construction, together with its attached panels, is flexed about an axis perpendicular to the axis the pintle.

This construction has substantial advantages over other combinations of materials and characteristics. The best materials can be selected for each portion without compromise to the other portions. For example, an extremely flexible and resilient plastic material can be chosen so that it moves with the panel. However, the structural stiffness for a proper hinge operation is provided by the pintle 80.

Figure 4:
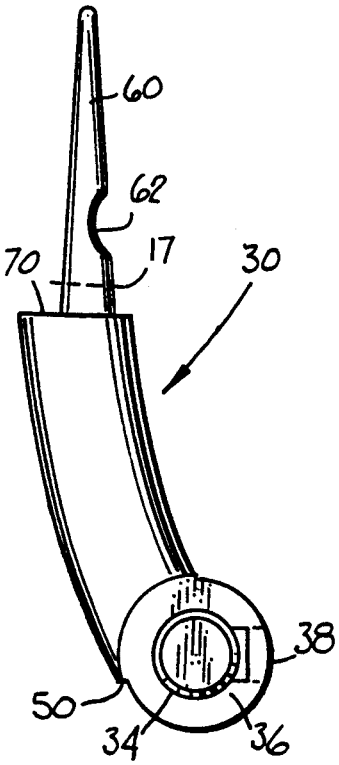
FIG. 4 is an end view of the leaf as shown in FIG. 3.
Figure 5:
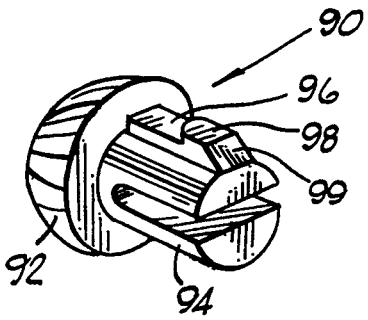
FIG. 5 is a perspective view of an end cap.
Figure 7:
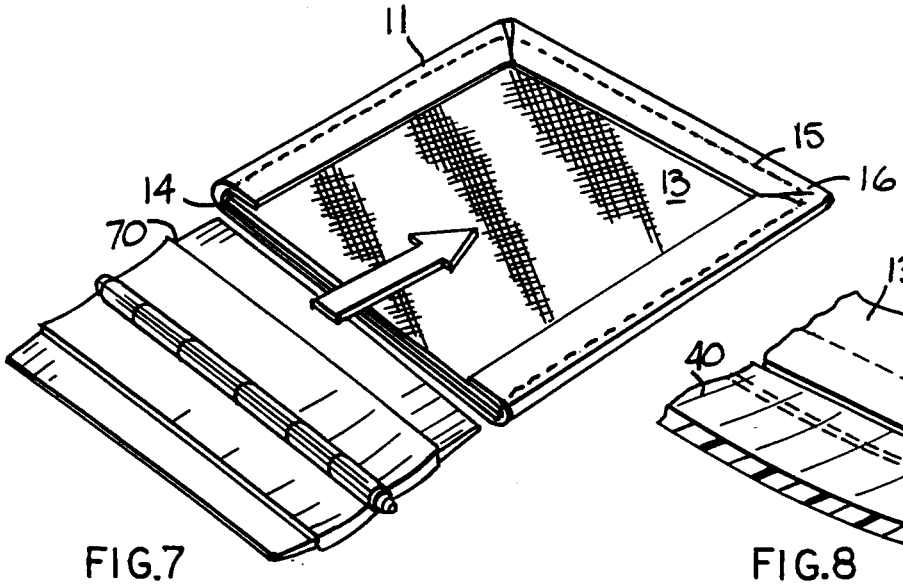
Figure 8:
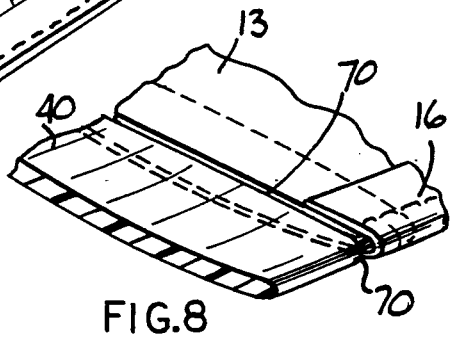
FIG. 8 is a detail of the joint between the hinge leaf and the panel.

In assembling a panel and hinge in accordance with the preferred embodiment, the layer of leather 12 is cut and the edges scived to form a smooth appearance when folded. A liner such as liner 13 is placed within the envelope formed by the panel and its folded edges 6 and three of the four edges are sewn together with fine stitching as is normal in the leather working art. This forms a pocket 14 for containing the leaf of the disclosed hinge. FIG. 7 shows the pocket 14 containing the tongue 60 up to the continuous step 70. The step 70 is sized to smooth the transition between the leaf and panel. Specifically, step 70 forms an edge or shelf which is one to one and a half times the thickness of the leather panel 12 on the outside or convex curved face of the body portion 40. The step 70 is formed on the end surface to also receive the wrapped edge of the leather panel 12 as detailed in FIG. 8. The dimension of the step 70 on the inner or concave side of the body portion 40 may be smaller (as shown in FIG. 4) since the liner 13, (be it cloth or another layer of leather) would be substantially thinner.

The overall joint is completed by stitching across the width of the panel through the layer 12 as well as through the tongue 60 along stitch line 17. Of course, traditional glues may be used to hold or supplement the attachment of the tongue in the panel. Also the assembly can be enhanced by providing tongue 60 with a roughened surface to help reduce slipping between it and the adjacent surfaces of the panel.

Figure 9A:
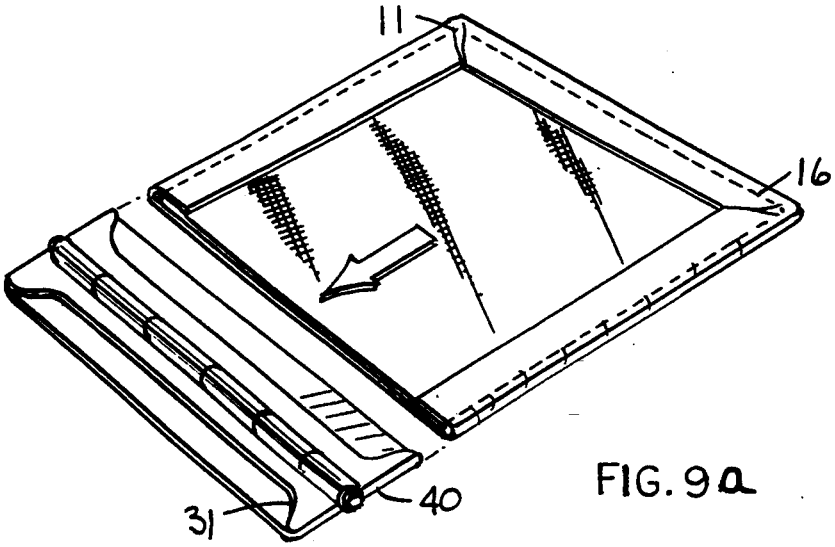
FIG. 9A is an alternative method of attaching the panel to the hinge.
Figure 9B:
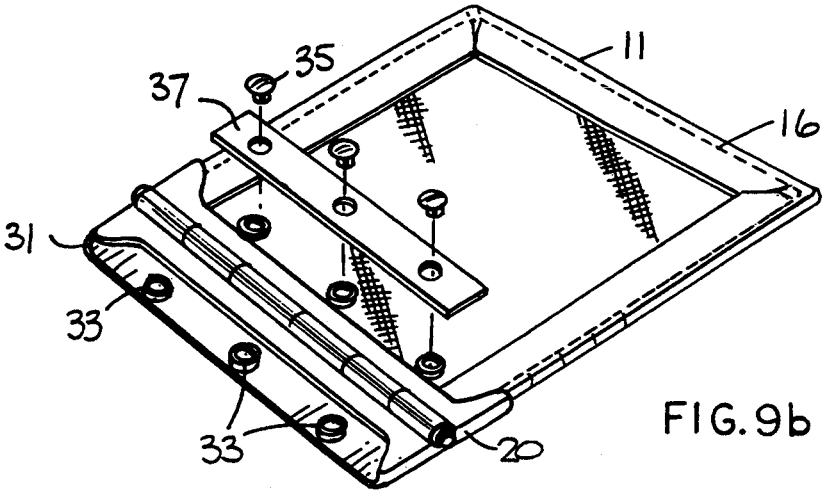
FIG. 9B is another alternative of attaching the panel to the hinge.

FIGS. 9*a* and 9*b* show alternative methods of attachment. Here, rather than the body portion 40 including a tongue along its edge, it includes a pocket 31 sized to receive the panel 11. Given the increased surface area involved in this construction an adhesive, such as a urethane reactive adhesive, may be used to install the panel in to the receiving pocket 31 for an even more durable but more complicated construction, the pocket 31 is provided with a series of upstanding bosses 33. The panel 11 is prepared with a series of holes punched through its various layers which line up with the bosses. An overlying cover plate 37 is placed over the assembly with rivets or screws 35 passing into the bosses to hold the cover panel in place.

Figure 10:
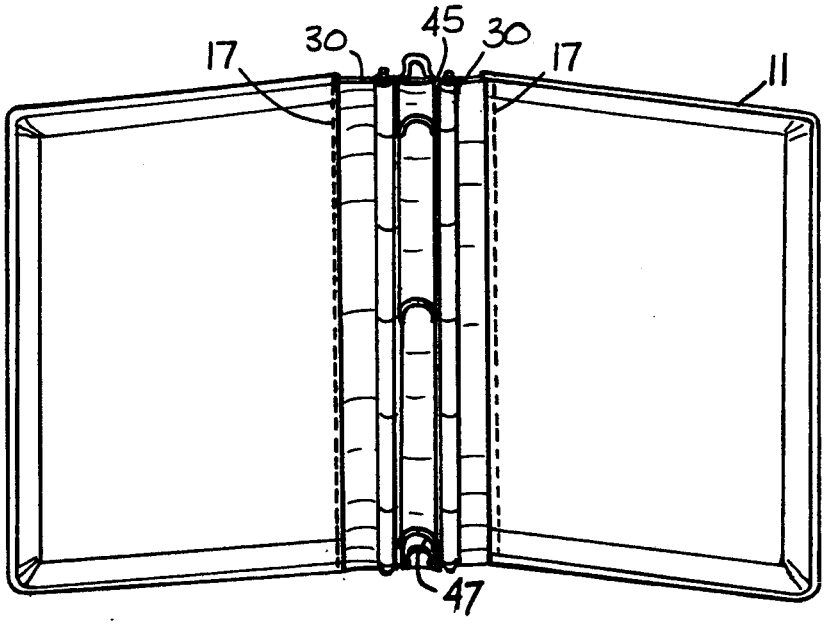
FIG. 10 shows the hinge construction in a binder or portfolio.

FIG. 10 shows a further embellishment of the instant invention. Here a pair of leaves 30, rather than engaging one another with their interlacing knuckles, engage a spine of the type used in a ring binder or the like having conventional paper engaging rings 47. The spine 45 includes properly spaced and dimensioned knuckles for interlacing with the adjacent leaf 30 on both its edges. Use of a small diameter pintle is the same as detailed above. Here again, the stitching 17 is used to hold the tongue (not shown) into the panels 11.

Figure 11:
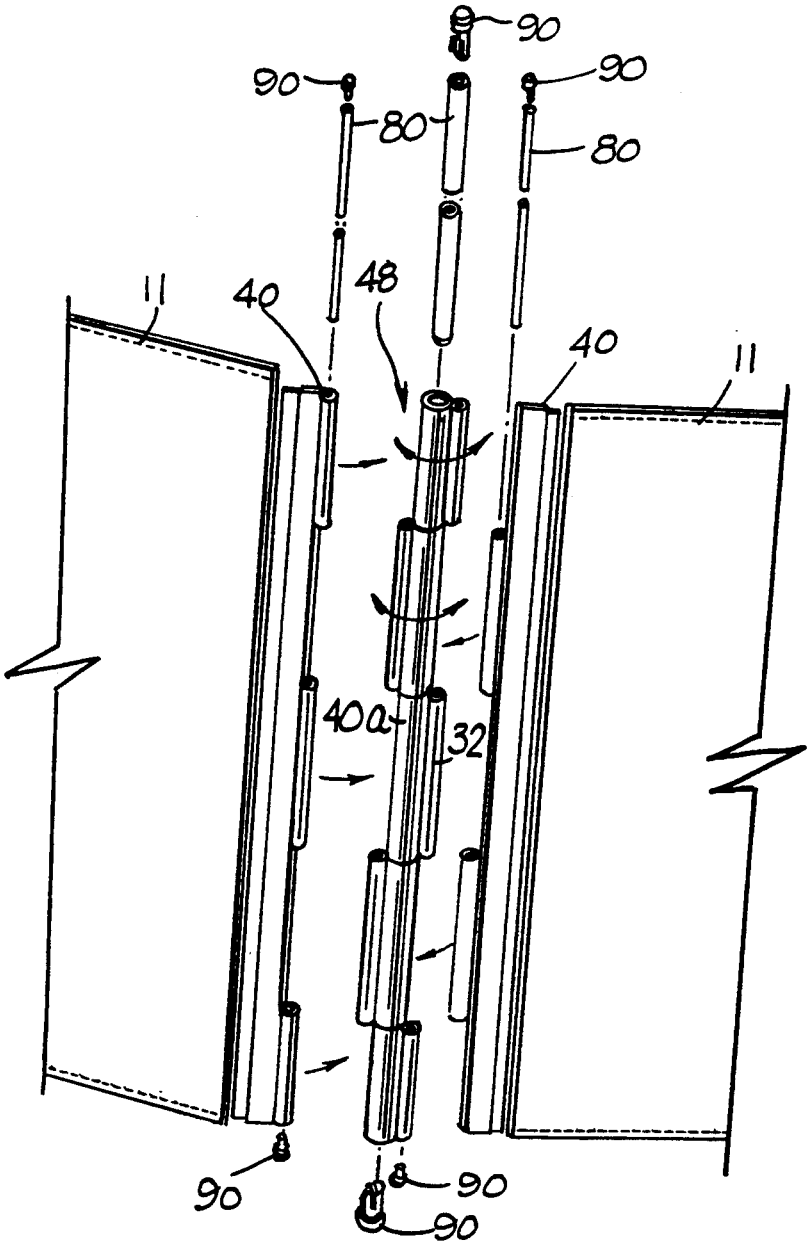
FIG. 11 shows an alternative construction of the hinge with an expansion feature.

FIG. 11 shows a further variation such that each leaf 30 with its body portion 40 and tongue are integrated with panels 11 rather than attaching directly one to the other, or to a simple spine-like member 45 in FIG. 10, each knuckle engages a separately and independently movable knuckle 32 each of which is attached to a tubular body portion 40A. The series of such assemblies are stacked one on the other and held together with a pintle 80 and end caps 90. This assembly in turn is attached by interleaving every other knuckle its adjacent leaf 30 using further of pintles 80 and end caps 90.

Figure 11A:
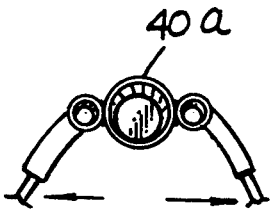
FIGS. 11A and 11B illustrate the operation of the construction of FIG. 11.
Figure 11B:
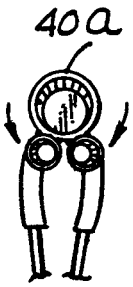

This construction has a further advantage over the previously detailed embodiments. While all take advantage of the curving body portion to provide a neat construction when the panels 11 are parallel with one another or overlying one another, this construction permits further expansion and contraction at the resulting hinged joint. FIG. 11A shows the independently mounted knuckles 32 positioned opposite one another along opposite sides of the hinged joint formed from tubular body portions 40*a*. FIG. 11B shows the leaves 30 moved towards one another a substantial distance because of the independently mounted knuckles rotate with the tubular members 40*a*. Thus, the personal leather good carrying this construction could have varying thicknesses without restriction. Also, the central pintle 80 could comprise a functional item such as a thin pencil or pen which could be withdrawn from a tubular pintle through tubular members 40 A.

Figure 12:
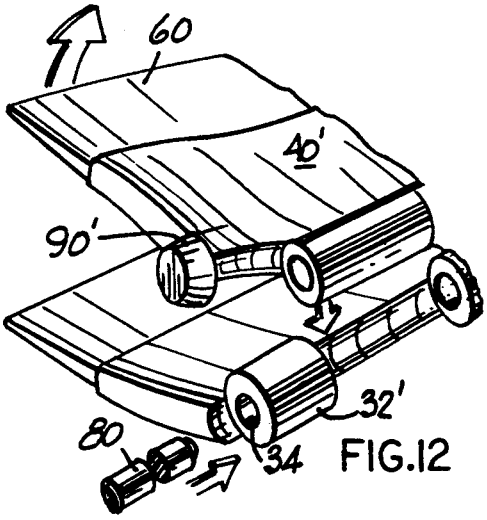
FIG. 12 shows a further modification of the device shown in FIG. 2.

As the main function of the end caps 90 are to retain the pintle 80 in its attaching position, FIG. 12 shows an alternative which takes full advantage of the flexible nature of the body portion 40. Here, body portion 40 is provided with an end cap like protrusion 90 which is in a place of the previously disclosed separate end cap 90. In this construction, the end portion carrying end cap like protrusion 90' is lifted upwardly while the knuckles are interleaved as before. The pintle 80 is inserted in the co-axial bores 34. The inherent resilience of the body portion 40' causes the end cap 90' to overlay the bore 34 of the end most knuckle 32' and trap the otherwise freely moving pintle 80 in position through the interleaved knuckles.

The advantages of the disclosed construction are many. First, it has a pleasing appearance and works well with the inherent flexibility in the panels which make up many personal leather goods. Secondly, a single mold can be used to form both interengaging leaves. This is possible since the leaves can be switched end to end to bring their concave interiors facing one another.

As detailed above, the particular construction permits choosing the best materials to do the best function in the overall hinge. The pintle, because of its small diameter and rigidity can use the most resilient, stiffest material available without compromise to the overall flexibility of the construction. The leaf material can be selected which gives the best finish and also the best resilience Tongue 60 can also be selected from materials which are compatible with the adjacent leather and lining layers of the panel 11 and can receive the fine stitching characteristic of good leather work. The end caps can be selected from materials which are identical to body portion 40 or of contrasting colored materials, or can be covered with contrasting materials such as precious metals. The curving body portion with its concave and convex faces also integrate well with panels, with the panels tending to remain parallel to one another even when materials are received between them, thus making the PLG compact when necessary or expand out to accommodate more and more items (bills, photographs, cards, and other papers).

We claim:

1. A hinge for personal leather goods comprising a pintle, a first hinge leaf, a second hinge leaf, each leaf having a body portion, a series of knuckles spaced along one edge of each said body portion, said knuckles being spaced from one another to permit the knuckles of each leaf to be interlaced with the other, said hinge knuckles including axially aligned bores which, when said knuckles are interlaced, define a hinge bore dimensioned to receive said pintle, a first knuckle adjacent an end of each said hinge leaf being positioned axially inward from the end of said hinge leaf and cooperating when said knuckles are interlaced to form a space between the end of the hinge leaf and said first knuckle, said hinge further comprising an end cap, the end cap including a cover having an axial dimension sized to fit flush within said space, said end cap being normally positioned in said space with said axial dimension in alignment with said hinge bore, said end cap further having means for affixing said end cap to said hinge, whereby said pintle is held in said hinge bore by said end cap, and said end cap is substantially flush in said space.

2. A hinge as set forth in claim 1 wherein said means for affixing said cap to said hinge comprises a shaft extending from said cover, and a detent on a side of said shaft, said shaft being sized to fit into the axial bore of said first knuckle and said detent sized to hold said end cap in said axial bore, and wherein said cover has a circumference dimension substantially equal to said first knuckle.

3. A hinge as set forth in claim 2 wherein said shaft is a split shaft and said detent further includes a ramp surface, said ramp surface engaging said axial bore to deflect said split shaft when said end cap is inserted in said axial bore.

4. A hinge as set forth in claim 3 wherein said axial bore of said first knuckle includes a cavity extending from the axial bore to its outer surface and said cavity is sized to receive said detent.

5. A hinge as set forth in claim 1 wherein said body portion terminates in the region of said space in a concave surface having a shape substantially conforming to the outer surface of the knuckle positioned in said space.

6. A hinge as set forth in claim 1 wherein said hinge leaves are held together with said pintle which passes through said interlacing knuckles, said pintle terminating short of the full extent of said hinge bore defined by said knuckles.

7. A hinge as set forth in claim 6 further including a second end cap at the opposite end of said first leaf, said pintle being normally captured in said hinge bore between said end caps.

8. A hinge as set forth in claim 1 wherein each said body portion curves about an axis parallel to said one edge such that when each said leaf is overlying one another, said body portions curve towards one another, whereby panels of said personal leather good connected by said hinge tend to remain parallel to one another even when materials are received between them.

9. A hinge as set forth in claim 1 wherein said first hinge leaf further includes a tongue extending along an edge parallel to said one edge, and wherein said tongue is of a deformable resilient material which is shaped to taper from a relatively thick root at its juncture with said leaf to a thin edge remote from said leaf.

10. A hinge as set forth in claim 1 wherein said first leaf is made of a material selected from a group consisting of a thermoplastic rubber, an ionomer polymer, an ABS, and a polycarbonate.

11. A hinge as set forth in claim 1 wherein said first leaf is made of a substantially flexible, resilient polymer material, and said pintle is made from a rod of fiber re-enforced plastic being substantially stiffer than the material of said leaf, whereby said pintle provides structure to said leaf and said leaf is flexible to bend with said personal leather good.

12. A hinge as set forth in claim 1 wherein said first leaf is made of an elastic, flexible material, said pintle is made of substantially rigid material, and said end cap is made from or coated with a metal.

13. A hinge for attaching a panel to another member, said panel having a layer of a material selected from the group consisting of leather and artificial leather, said hinge having a first leaf which includes a series of knuckles arranged along one longitudinal edge, said knuckles being spaced one from another to receive a second series of knuckles on said another member, said leaf including a body portion connected to said series of knuckles, said first leaf further comprising means for attaching said leaf to said panel, said body portion has an overall shape which curves substantially continuously about an axis parallel to said one longitudinal edge, whereby when said first leaf is attached to said panel and said panel is overlying said another member, said panel overlies said another member in a substantially compact manner and tends to remain substantially parallel to said another member when materials are received between said panel and said another member.

14. A hinge as set forth in claim 13 wherein the end of said body portion extends beyond an end most knuckle of said series of knuckles.

15. A hinge as set forth in claim 14 wherein said hinge includes a moveable end cap having a cover which has a height dimension, and further has a diameter substantially corresponding to the outer diameter of said series of knuckles, the body portion extending beyond said end most knuckle a distance substantially equal to the height dimension of said cover of said end cap.

16. A hinge as set forth in claim 13 wherein said body portion is connected to said series of knuckles by a continuous ridge running the length of said body portion, whereby when said knuckles are interleaved with said second series of knuckles on said another member, the interleaving knuckles appear as a continuous cylinder.

17. A hinge as set forth in claim 16 wherein said means for attaching said leaf to said panel comprises a tongue having a length substantially equal to and extending along said body portion, the tongue joining said body portion at a step, the height of said step substantially equal to the thickness of said layer of material.

18. A hinge as set forth in claim 17 wherein said panel includes a lining, and wherein said layer of material is wrapped around edges of said lining, and wherein said step continues around said tongue where said tongue attaches to said body portion, said tongue being dimensioned to be stitched to said panel by inserting said tongue between said liner and said layer of material, whereby the adjacent edge of the body portion neatly blends with the panel.

19. A hinge as set forth in claim 13 wherein said another member is a second leaf substantially identical to said first leaf, such that a single mold can produce both said first leaf and said second leaf.

20. A hinge as set forth in any one of claims 13, 14, 16, 15, 17, or 18 in combination with said panel, and wherein said another member is a second panel having a layer of a material selected from leather and artificial leather.

21. A hinge comprising a pair of leaves made of a thermoplastic elastomer, each having a set of interengaging knuckles, a generally solid, cylindrical pintle made of a fiber reinforced polymer passing through said interengaging knuckles, the thermoplastic elastomer material from which said leaves are made having a flexural modulus, and the material from which said pintle is made having a higher flexural modulus, the ratio of said flexural modulus to said higher flexural modulus is greater than about 1 to 7.

22. A hinge as set forth in claim 21 wherein said ratio at least 1 to about 200.

23. A hinge as set forth in claim 21 wherein said ratio is preferably in the range of 1 to about 200 to 1 to about 1,000.

24. A hinge for personal leather goods comprising a generally cylindrical, solid pintle, a first hinge leaf, a substantially identical second hinge leaf, each leaf having a body portion, a series of knuckles spaced along one edge of each said body portion, said knuckles being spaced from one another to permit the knuckles of each leaf to be interlaced with the other, said hinge knuckles including axially aligned bores receiving said pintle, said hinge further comprising an end cap, the end cap including a cover and an axially extending pin sized to frictionally engage and be held within said axially aligned bores, said pintle having an axial length to fit within said axially aligned bores while leaving room for said axially extending pin of said end cap, whereby said pintle is held in said axially aligned bores by said end cap.

25. A small container having at least a major surface covered with a material selected from a group consisting of leather and artificial leather and usually carried by a person and used to organize or protect that person's effects contained therein, said container including at least a pair of panels which hinge relative to one another to permit access to said person's effects contained between said pair of panels comprising a layer of a material selected from leather and artificial leather on one major surface of at least one panel of said pair of panels fastened to a liner on the other major surface so as to form an elongated pocket along one edge thereof, and a hinge having a first leaf with a series of spaced knuckles along one longitudinal dimension parallel to said one edge, a pintle, and a tongue extending along said one longitudinal dimension into said pocket, said series of knuckles engaging a second set of knuckles carried on a second panel of said pair of panels to define a hinge bore having an overall axial dimension therethrough with said pintle passing through said hinge bore, said first leaf being made of a resilient, flexible material which complements the flexibility and resilience of said first panel when said first panel is attached to said leaf, said knuckles being attached one to another by said pintle, said pintle being substantially stiffer than said leaf, said pintle having a length substantially shorter than the overall axial dimension of said bore, said hinge further including means for capturing said relatively stiffer pintle in said bore, said means being located at each end of said hinge bore.

26. A small container as set forth in claim 25 wherein said layer of material of said at least one of said pair of panels is a layer of leather and said liner is of a different material, and wherein said tongue of said leaf is attached in the pocket formed between said leather layer and said liner along said one edge by stitches passing through said layer of leather, said tongue, and said liner.

27. A small container as set forth in claim 25 wherein said second panel of said pair of panels comprises a layer of leather and a liner, said second set of knuckles formed on an edge of a second leaf having a tongue, said tongue of said second leaf being fastened to said second panel by stitches.

28. A small container as set forth in claim 25 wherein said means for capturing said pintle comprises end caps located at opposite ends of said hinge, said end caps made of material having a metallic appearance.

29. A small container as set forth in claim 28 wherein said metallic appearance is that of gold or silver.

* * * * *